US012677919B2

(12) United States Patent
Zhuang

(10) Patent No.: US 12,677,919 B2
(45) Date of Patent: Jul. 14, 2026

(54) PHONE CASE WITH FINGERTIP GYROSCOPE FUNCTION

(71) Applicant: Guangxiang Zhuang, Shenzhen (CN)

(72) Inventor: Guangxiang Zhuang, Shenzhen (CN)

( * ) Notice: Subject to any disclaimer, the term of this patent is extended or adjusted under 35 U.S.C. 154(b) by 244 days.

(21) Appl. No.: 18/755,729

(22) Filed: Jun. 27, 2024

(65) Prior Publication Data

US 2024/0341435 A1 Oct. 17, 2024

(30) Foreign Application Priority Data

Jul. 21, 2023 (CN) ..... 202321963894.5

(51) Int. Cl.
*A45C 15/00* (2006.01)
*A45C 11/00* (2006.01)
*A63F 7/04* (2006.01)

(52) U.S. Cl.
CPC ..... *A45C 15/00* (2013.01); *A45C 11/00* (2013.01); *A63F 7/04* (2013.01); *A45C 11/002* (2025.01)

(58) Field of Classification Search
CPC ..... A45C 15/00; A45C 11/00; A45C 11/002; A63F 7/04
See application file for complete search history.

(56) References Cited

U.S. PATENT DOCUMENTS

2019/0141174 A1* 5/2019 Britt ..... H04M 1/6041
2020/0169626 A1* 5/2020 Britt ..... H04M 1/04
2023/0045953 A1* 2/2023 Yan ..... A45C 11/00

* cited by examiner

*Primary Examiner* — Ankur Jain
(74) *Attorney, Agent, or Firm* — Hemisphere Law, PLLC

(57) ABSTRACT

The present disclosure discloses a phone case with fingertip gyroscope function, the phone case includes a fingertip gyroscope in a first area, the fingertip gyroscope includes a first marble, a turntable surface, a bearing, a pointer, and a rotating member, the bearing is disposed in the center of the turntable surface, the pointer is fixed on the rotating member, and the rotating member is movably connected to the bearing, and after rotating on the rotating member by force, release and observe through a transparent cover plate, the pointer rotates with the rotation of rotating member and the first marble also rolls in the first turntable surface with the rotation of the pointer, and during the rolling process, the first marble rolls into the marble hole, and the user can play with the fingertip gyroscope, anytime and anywhere, to release pressure and relieve mood.

9 Claims, 5 Drawing Sheets

PHONE CASE WITH FINGERTIP GYROSCOPE FUNCTION

TECHNICAL FIELD

The present disclosure relates to the field of phone case technology, particularly to a phone case with fingertip gyroscope function.

BACKGROUND ART

Fingertip gyroscope, also known as finger gyroscope, is a small toy that has a center symmetric structure and can rotate above the fingers, and the design combination takes a bidirectional or multi-directional symmetrical body as the main body in which a bearing is centrally embedded, forming a new type of object that can rotate in a plane. You can rotate it simply by grasping and toggling with several fingers. Playing with fingertip gyroscopes can release emotion, relax body and mind, and relieve stress, and it is currently a popular small toy. However, the one who wants to play with a fingertip gyroscope anytime and anywhere need to carry this toy along the journey, and it is quite troublesome for the one who don't often carry backpacks to take a fingertip gyroscope.

SUMMARY OF THE DISCLOSURE

One of the purposes of the present disclosure is to provide a phone case with fingertip gyroscope function, in order to address the above problems.

The phone case with a fingertip gyroscope function in the present disclosure can be realized through the following technical solutions:

The present disclosure provides a phone case with fingertip gyroscope function, wherein the phone case includes a main body and a cover plate, the side wall of the main board of phone case encloses around the main board of phone case to form a fence, and the cover plate is disposed above the fence to connect with the main body of phone case to form a sealing chamber, wherein the sealing chamber includes a first area and a second area, the first area is disposed on the side of the camera area of the phone case, and the second area is disposed below the first area, and the first area is provided with a fingertip gyroscope, and the second area is provided with a board game;

the fingertip gyroscope includes a first marble, a turntable surface, a bearing, and a pointer located within the first area, as well as a rotating member located outside the first area, the turntable surface includes a first turntable surface and a second turntable surface, and the first turntable surface is planar on the main body of phone case, the second turntable surface is convex on the main body of phone case and enclosed outside of the first turntable surface, and a plurality of marble holes concaved on the main body of phone case are provided on a portion of the second turntable near the first turntable surface;

the bearing is fixed in the center of the first turntable surface, the rotating member is connected to the bearing through a rotating shaft, and the middle of the pointer is fixed on the rotating member, the rotating member helps rotate the pointer, and the first marble rolls on the turntable surface according to the rotation direction of pointer and enters the marble hole on the second turntable surface.

In some embodiments, the outer surface of rotating member is provided with a structure to increase friction force.

In some embodiments, a scale is provided on the first turntable, and the scale is a clock scale or a point scale.

In some embodiments, the marble hole is located on the outer side of the scale.

In some embodiments, the board game includes a metal rod, a second marble, a first fixing member, a second fixing member, and a spring; the metal rod is movably disposed on the side of the fence in the second area; one or two of the holes and spiral rings are respectively disposed in the second area, and the metal rod impacts the second marble to roll in the second area, so that the second marble enters the hole or spiral ring; the first fixing member is disposed on the main body of the phone case to position the second marble; the second fixing member is disposed on the fence, and is connected to the first end of the metal rod to fix the metal rod; the metal rod is provided with an accommodating groove in which a spring is disposed, one end of the spring is connected to one end of the accommodating groove, and the diameter of the spring is greater than the height of the accommodating groove.

In some embodiments, a movable opening is provided at the position of the metal rod corresponding to the fence, and the height of the movable opening is lower than that of the fence.

In some embodiments, a groove is provided on the metal rod, and through the groove the metal rod moves at the movable opening.

In some embodiments, the materials of the first marble and the second marble are metal or glass.

In some embodiments, the second fixing member is movably connected to the metal rod.

Compared with prior art, the phone case with fingertip gyroscope function in the present disclosure has the following beneficial effects:

The present disclosure discloses a phone case with fingertip gyroscope function, the phone case includes a fingertip gyroscope in a first area, the fingertip gyroscope includes a first marble, a turntable surface, a bearing, a pointer, and a rotating member, the bearing is disposed in the center of the turntable surface, the pointer is fixed on the rotating member, and the rotating member is movably connected to the bearing, and after rotating on the rotating member by force, release and observe through a transparent cover plate, the pointer rotates with the rotation of rotating member and the first marble also rolls in the first turntable surface with the rotation of the pointer, and during the rolling process, the first marble rolls into the marble hole, and the user can play with the fingertip gyroscope, anytime and anywhere, to release pressure and relieve mood. Compared to prior art, users can play with phones and carry them conveniently without carrying fingertip gyroscopes, which increases the fun and visibility of phone case while improving the user experience.

BRIEF DESCRIPTION OF THE DRAWINGS

In order to explain the technical solution of the embodiments in the present disclosure more clearly, a brief introduction will be made to the accompanying drawings required in the embodiments. It should be understood that the following drawings only illustrate certain embodiments of the present disclosure, and therefore should not be regarded as a limitation to the scope, and those of ordinary skill in the art can also, without creative work, obtain other relevant drawings based on these drawings.

DETAILED DESCRIPTION OF THE EMBODIMENTS

Figure 1:
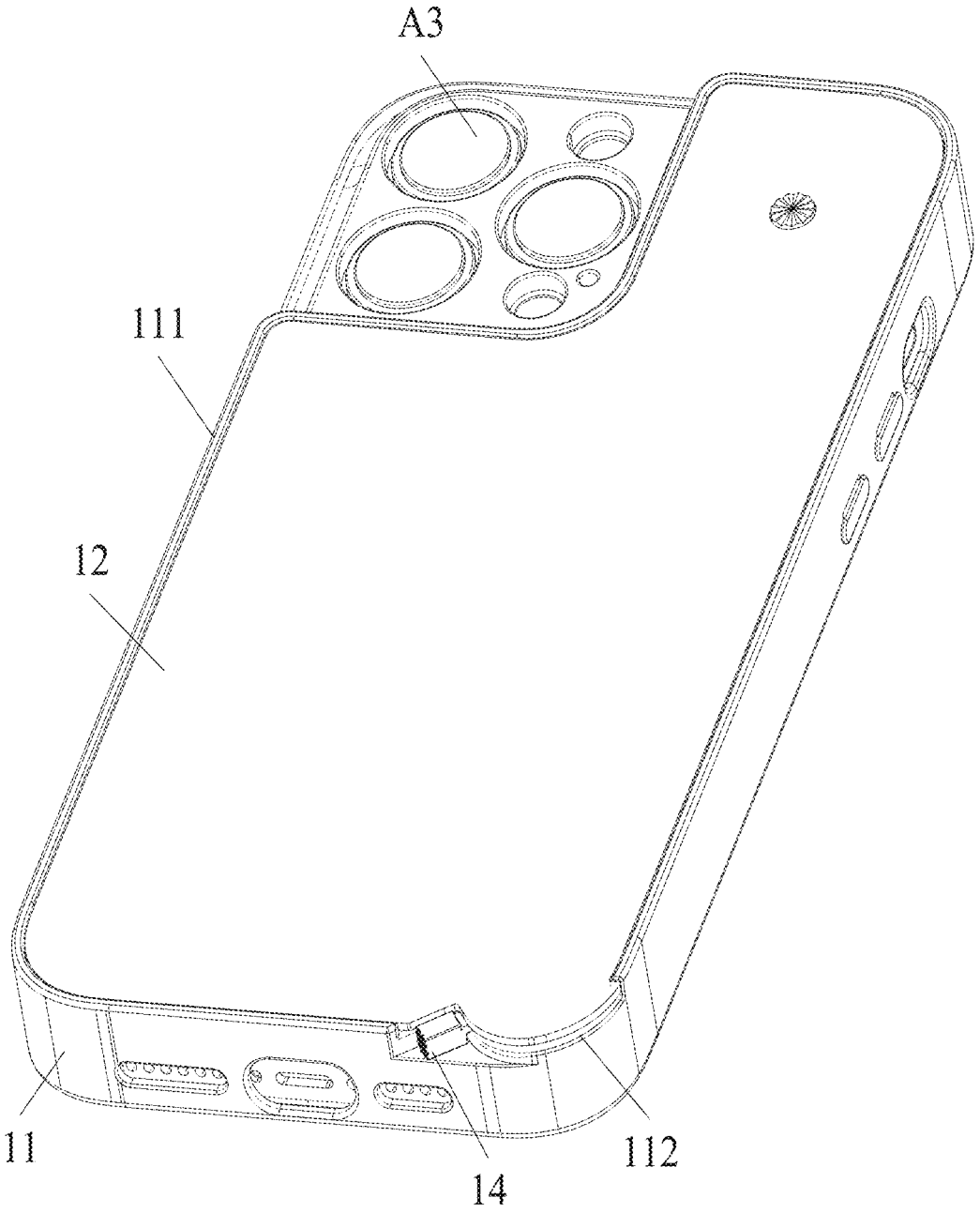
FIG. 1 is a schematic diagram of the structure of a phone case with fingertip gyroscope function in the present disclosure.
Figure 2:
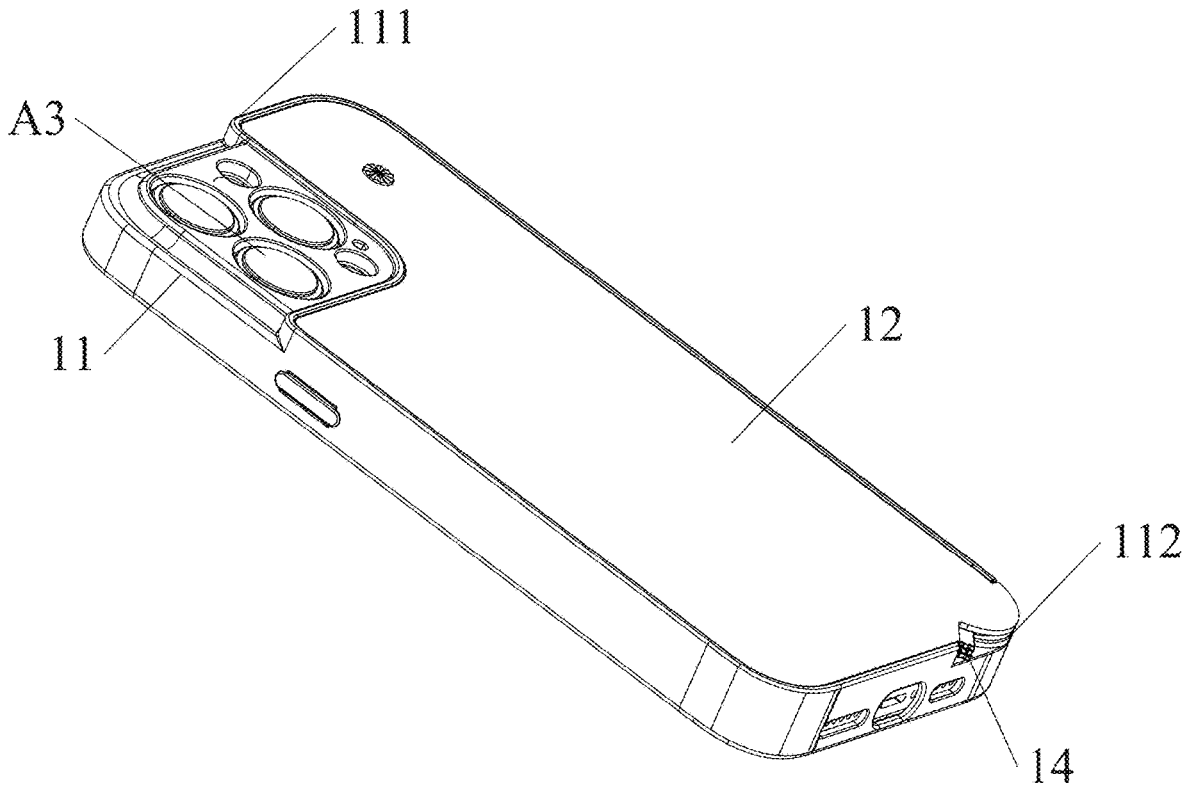
FIG. 2 is a schematic diagram of the structure of the other side of phone case with fingertip gyroscope function shown in FIG. 1 of the present disclosure.

In order to clarify the purpose, technical solution, and advantages of the embodiments of the present disclosure, the technical solution in the embodiments of the present disclosure will be described below clearly and completely in conjunction with the accompanying drawings. Obviously, the embodiments described are only a part of the embodiments of the present invention, rather than all the embodiments. The components of the embodiments of the present disclosure, which are typically described and shown in the accompanying drawings, can be arranged and designed in various different configurations.

Therefore, the following detailed description for the embodiments of the present disclosure provided in the drawings is not intended to limit the scope of the claimed protection of the present disclosure, but only to represent the selected embodiments of the present disclosure. Based on the embodiments in the present disclosure, all other embodiments obtained by those of ordinary skill in the art without creative work fall within the scope of protection of the present disclosure. It should be noted that similar labels and letters represent similar items in the following drawings. Therefore, as long as an item is defined in a drawing, further definition or explanation is unnecessary in subsequent drawings.

It should be noted that, in the description of the present disclosure, the terms "above", "below" and the like indicate the orientation or position relationship based on the orientation or position relationship shown in the drawings, or the orientation or position relationship habitually placed during the use of the present disclosure product, and are only used to facilitate and simplify the description of the present disclosure, rather than indicating or implying that the device or component referred to must have a specific orientation, or must be constructed and operated in a specific orientation, and therefore they cannot be understood as a limitation on the present disclosure.

In addition, in the present disclosure, unless otherwise specified and limited, the first feature above or below the second feature may include direct contact between the first and second features, or may include contact between other features through them rather than direct contact. Moreover, the first feature above, on, and over the second feature includes the first feature directly above and diagonally above the second feature, or simply indicates that the first feature is horizontally higher than the second feature. The first feature below, under and beneath the second feature includes the first feature directly below and diagonally below the second feature, or simply indicates that the horizontal height of the first feature is less than that of the second feature.

In addition, the terms "horizontal" and "vertical" do not mean that the component is required to be absolutely horizontal or suspended, but can be slightly tilted. If "horizontal" only refers to its direction being more horizontal compared to "vertical", it does not mean that the structure must be completely horizontal, but can be slightly tilted.

It should also be noted that, in the description of the present disclosure, unless otherwise specified and limited, the terms "disposed", "connected to", and "connected with" should be broadly understood, for example, can be fixed connections, detachable connections, or integrated connections; can be a mechanical connection or an electrical connection; can be direct connection, or indirect connection through an intermediate medium, or can be an internal connection between two components. those of ordinary skill in the art can understand the specific meanings of the above terms in the present disclosure based on specific circumstances.

As shown in FIG. 1-5, the present disclosure provides a phone case with fingertip gyroscope 16 function, the phone case includes a main body 11 and a cover plate 12, the side wall of the main board of phone case encloses around the main board of phone case to form a fence 111, and the cover plate 12 is disposed above the fence 111 to connect with the main body 11 of phone case to form a sealing chamber, wherein the sealing chamber includes a first area A1 and a second area A2, the first area A1 is disposed on the side of the camera area A3 of the phone case, and the common phone camera is located in the upper left corner or in the upper middle area of the phone, and the phone case is provided with a camera area A3 in the corresponding area to ensure that the phone camera can work normally when the phone is fitted with the case. In this embodiment, when the camera is disposed in the upper left corner, and the camera area A3 of the phone case is also set in the upper left corner, then the first area A1 is set in the upper right corner and the second area A2 is set below the first area A1. The first area is provided with a fingertip gyroscope, and the second area is provided with a board game;

the fingertip gyroscope 16 includes a first marble (not shown in the figure), a turntable surface, a bearing 133, and a pointer 134 located within the first area A1, as well as a rotating member 135 located outside the first area A1, the turntable surface includes a first turntable surface 131 and a second turntable surface 132, the first turntable surface 131 is on the phone case body 11, that is, the first turntable surface 131 defines a circular area on the phone case body 11 and is at the same horizontal plane as the phone case body 11; the second turntable surface 132 is convex on the phone case body 11 and enclosed outside the first turntable surface 131, the height of the second turntable surface 132 is less than or equal to that of the fence 111 and, if the height of the second turntable surface 132 is less than that of the fence 111, the height difference between the fence 111 and the second turntable surface 132 will be less than the diameter of the first marble to prevent the first marble from rolling out of the second turntable surface 132. A plurality of marble holes recessed on the main body 11 of the phone case are provided at a position near the first turntable surface 131 of the second turntable, and the first marble, when rolling within the first turntable surface 131, enters the marble holes on the second turntable surface 132 accordingly.

The bearing 133 is fixed in the center of the first turntable surface 131, the rotating member 135 is fixed in the middle of the pointer 134, and the rotating member 135 is connected to the bearing 133 through a movable shaft, the rotating member 135 drives the pointer 134 rotate, and a through-hole is provided at the corresponding position of the rotating member 135 on the cover plate 12, the rotating member 135 penetrates the cover plate 12 and protrudes outside the cover plate 12. The first marble rolls on the turntable surface according to the rotation direction of pointer 134 and, when pointer 134 stops, enters the marble hole of the second dial surface 132. Game rules can be set for an interactive guessing game for two players, for example, the one who successfully guesses the certain marble hole in which the first marble will finally stay after rotation with the pointer 134 is the game winner. The game rules for a two-player game can be set according to actual needs, which will not be further detailed here.

When playing with the fingertip gyroscope 16, users rotates rotating member 135 by force and then releases, the pointer 134 rotates with the rotation of rotating member 135 and the first marble also rolls in the first turntable surface 131 with the rotation of the pointer 134, and during the rolling process, the first marble rolls into the marble hole, and the user can play with the fingertip gyroscope 16, anytime and anywhere, to release pressure and relieve mood. Two players can also play interactive guessing games to increase fun. Compared to prior art, users can play with a phone conveniently without carrying a fingertip gyroscope, which increases the fun and visibility of phone case while improving the user experience.

In one embodiment, the outer surface of the rotating member 135 is provided with a structure to increase friction, for example, the rough surface of the outer surface of rotating member 135 may have an uneven structure to allow users to rotate the rotating member 135, so that the pointer 134 rotates on the first turntable surface 131, and the first marble rolls under the impact of the pointer 134. The first turntable is provided with a scale (not shown in the figure), either a clock scale or a point scale. The pointer 134, when stops, can indicate the scale. In the battle game, user can set the pointer 134 towards the scale to calculate the score, improving the fun of fingertip gyroscope 16 game.

In one embodiment, the marble hole is located outside of the scale, and by rotating the pointer 134, the first marble rolls into the marble hole. In battle games, scores can be calculated based on the scale corresponding to the first marble, improving the fun of fingertip gyro 16 games.

In one embodiment, the board game includes a metal rod 14, a second marble 16, a first fixing member 15, a second fixing member 20, and a spring 19; the fluorescent powder on the second area A2 will, at night or in dimly lit areas, emit weak light for illumination, and metal rod 14 is movably disposed on the side of fence 111 in the second area A2 and, in this embodiment, metal rod 14 is set in the lower right corner of the second area A2; one or two of the holes 17 and spiral circle 18 are respectively set in the second area A2, and the metal rod 14 impacts the second marble 16 to roll in the second area A2, so that the second marble 16 enters the hole 17 or spiral circle 18; the first fixing member 15 located on the main body 11 of the phone case positions the second marble 16, the position of the first fixing member 15 is close to that of the metal rod 14 and, preferably, is at the diagonal position in the lower right corner of the second area A2, the first fixing member 15 positions the second marble 16, and the second marble 16 rolls within the second area A2 under the impact of the metal rod 14; the second fixing member 20 is disposed on the fence 111, and is connected to the first end of the metal rod 14 to fix the metal rod 14, and when the metal rod 14 is not used, the metal rod 14 is fixed on the second fixing member 20 and is accommodated inside the phone case. If it is necessary to play board games, remove the metal rod 14 from the second fixing member 20, and the metal rod 14 can move freely and collide with the second marble 16 at different angles.

Figure 5:
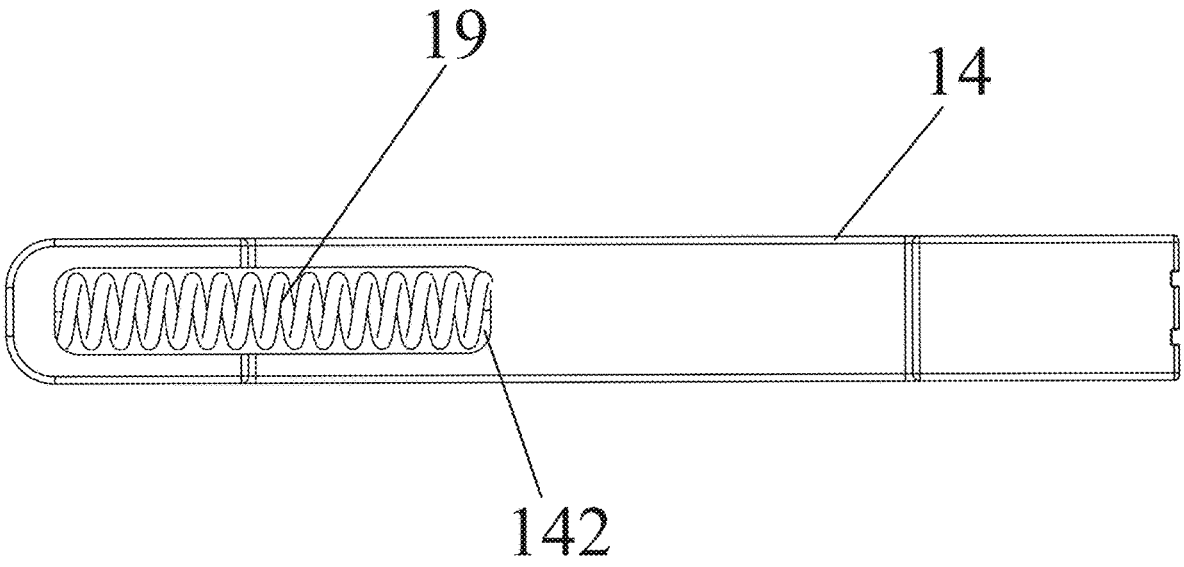
FIG. 5 is a schematic diagram of the structure of the metal rod and spring of a phone case with fingertip gyroscope function in the present disclosure.

The metal rod 14 is provided with an accommodating groove 142, as shown in FIG. 5, the accommodating groove 142 is disposed on one side of the metal rod 14 facing the phone case body 11, and the spring 19 is disposed inside the accommodating groove 142, one end of the spring 19 is connected to one end of the accommodating groove 142, and the diameter of the spring 19 is greater than the height of the accommodating groove 142; when the metal rod 14 is used to impact the ball, the metal rod 14 can be pulled towards the outside of the second area A2 to make the end of the metal rod 14 in the second area A2 on the side of the second marble 16, then the spring 19 is compressed against the fence 111, and after the impact angle of the metal rod 14 is fixed, the metal rod 14 can be released to automatically impact the second marble 16 under the tension of spring 19.

In one embodiment, a movable opening 112 is provided at the position of the metal rod 14 corresponding to the fence 111, and the height of the movable opening 112 is lower than that of the fence 111, so that the metal rod 14 can move in the gap between the movable opening 112 and the fence 111.

In one embodiment, a groove 141 is provided on the metal rod 14, and the metal rod 14 moves at the movable opening 112 through the groove 141. The metal rod 14 is provided with a groove 141 that can move on the movable opening 112 for aiming and impacting the second marble 16; a buffer sleeve is provided at one end of metal rod 14 to reduce the rebound force when fingers press the metal rod 14 and, specifically, the buffer sleeve is made of silicone. The second marble 16 is made of metal or glass and, in this embodiment, the second marble 16 is a spherical steel ball. In order to better position and fix the second marble 16, a first fixing member 15 is set directly below the second marble 16, and the first fixing member 15 is a magnet that can adsorb the spherical steel ball.

In one embodiment, the first marble is made of metal or glass.

In one embodiment, the second fixing member 20 is movably connected to the metal rod 14. The second fixing member 20 can be a magnet or a bayonet, and the second fixing member 20 can be a magnet, and the magnet is fixed on the fence 111 and on the side of the movable opening 112 to adsorb and fix the metal rod 14 through adsorption.

Figure 3:
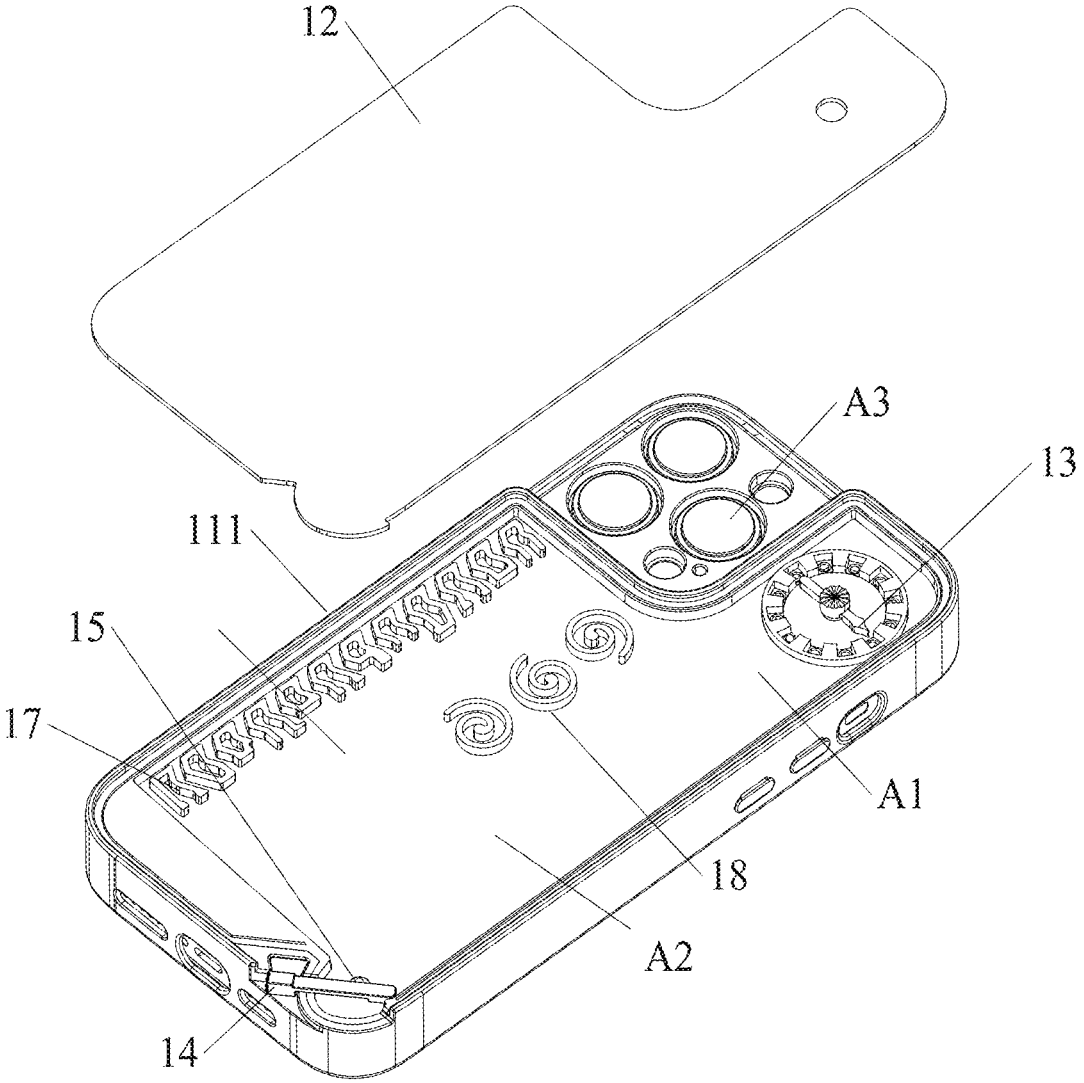
FIG. 3 is a schematic diagram of the partially exploded structure of phone case with fingertip gyroscope function shown in FIG. 1 of the present disclosure.
Figure 4:
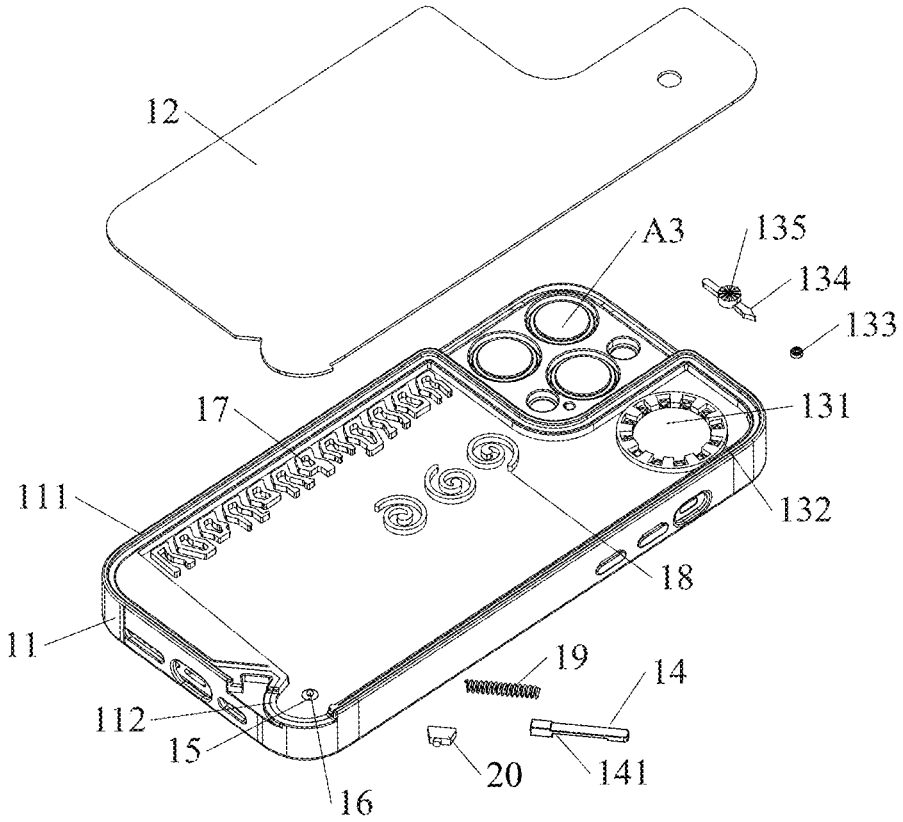
FIG. 4 is a schematic diagram of the explosive structure of phone case with fingertip gyroscope function shown in FIG. 1 of the present disclosure.

Referring to FIGS. 3 and 4, at least one hole 17 is located in the second area A2, and its position can be adjusted according to actual needs; In this embodiment, a plurality of holes 17 are arranged side by side on the side of the fence 111; the number of holes 17 can be one, two, three, or more. At least one spiral circle 18 is located in the second area A2, and its position can be set according to actual needs; In this embodiment, the number of spiral circles 18 is three, and three spiral circles 18 are arranged side by side in the center position of the second area A2; In other embodiments, the number of spiral circles 18 may be one, two, four, or more.

When playing board games, observe through a transparent cover plate, move the metal rod on the movable opening to aim at the shooting angle by stretching the metal rod, and eject the metal rod through a spring to hit the second marble, moreover, the groove can limit the metal rod to move at the movable opening, and prevent it from detaching from the phone case or falling into the second area. The application of fluorescent powder makes it possible for users to play games at night or in a dim place. When the board game is not in use, the marbles and metal rod can be separately fixed by the first fixing member and second fixing member.

The technical features of the above embodiments can be combined in any way. To make the description concise, not all possible combinations of the technical features in the above embodiments have been eworkated. The combination of these technical features, however, should be considered within the scope of the specification as long as there is no contradiction.

The above embodiments that only express several implementations of the present disclosure are described specifically and in detail, but cannot be understood as a limitation on the scope of the present disclosure patent. It should be noted that, without departing from the concept of the present disclosure, those of ordinary skill in the art can make several deformations and improvements, all of which fall within the scope of protection of the present disclosure. Therefore, the scope of protection of the present disclosure patent should be subject to the claims attached.

The invention claimed is:

1. A phone case with fingertip gyroscope function, wherein the phone case includes a main body and a cover plate, the side wall of the main board of phone case encloses around the main board of phone case to form a fence, and the cover plate is disposed above the fence to connect with the main body of phone case to form a sealing chamber, wherein the sealing chamber includes a first area and a second area, the first area is disposed on the side of the camera area of the phone case, and the second area is disposed below the first area, and the first area is provided with a fingertip gyroscope, and the second area is provided with a board game;

the fingertip gyroscope includes a first marble, a turntable surface, a bearing, and a pointer located within the first area, as well as a rotating member located outside the first area, the turntable surface includes a first turntable surface and a second turntable surface, and the first turntable surface is planar on the main body of phone case, the second turntable surface is convex on the main body of phone case and enclosed outside of the first turntable surface, and a plurality of marble holes concaved on the main body of phone case are provided on a portion of the second turntable near the first turntable surface;

the bearing is fixed in the center of the first turntable surface, the rotating member is connected to the bearing through a rotating shaft, and the middle of the pointer is fixed on the rotating member, the rotating member helps rotate the pointer, and the first marble rolls on the turntable surface according to the rotation direction of pointer and enters the marble hole on the second turntable surface.

2. The phone case with fingertip gyroscope function according to claim 1, wherein the outer surface of rotating member is provided with a structure to increase friction force.

3. The phone case with fingertip gyroscope function according to claim 1, wherein a scale is provided on the first turntable, and the scale is a clock scale or a point scale.

4. The phone case with fingertip gyroscope function according to claim 3, wherein the marble hole is located on the outer side of the scale.

5. The phone case with fingertip gyroscope function according to claim 1, wherein the board game includes a metal rod, a second marble, a first fixing member, a second fixing member, and a spring; the metal rod is movably disposed on the side of the fence in the second area; one or two of the holes and spiral rings are respectively disposed in the second area, and the metal rod impacts the second marble to roll in the second area, so that the second marble enters the hole or spiral ring; the first fixing member is disposed on the main body of the phone case to position the second marble; the second fixing member is disposed on the fence, and is connected to the first end of the metal rod to fix the metal rod; the metal rod is provided with an accommodating groove in which a spring is disposed, one end of the spring is connected to one end of the accommodating groove, and the diameter of the spring is greater than the height of the accommodating groove.

6. The phone case with fingertip gyroscope function according to claim 5, wherein a movable opening is provided at the position of the metal rod corresponding to the fence, and the height of the movable opening is lower than that of the fence.

7. The phone case with fingertip gyroscope function according to claim 6, wherein a groove is provided on the metal rod, and through the groove the metal rod moves at the movable opening.

8. The phone case with fingertip gyroscope function according to claim 7, wherein the materials of the first marble and the second marble are metal or glass.

9. The phone case with fingertip gyroscope function according to claim 5, wherein the second fixing member is movably connected to the metal rod.

* * * * *